United States Patent [19]

Nelson

[11] 4,307,548

[45] Dec. 29, 1981

[54] METHOD OF CONSTRUCTING HOUSES

[76] Inventor: David R. Nelson, P.O. Box 148, Stacy, Minn. 55079

[21] Appl. No.: 44,646

[22] Filed: Jun. 1, 1979

[51] Int. Cl.[3] ..... E04B 1/32

[52] U.S. Cl. ..... 52/90; 52/580

[58] Field of Search ..... 52/90, 745, 220, 474, 52/578, 93, 580, 582, 86

[56] References Cited

U.S. PATENT DOCUMENTS

| | | | |
|---|---|---|---|
| 1,421,124 | 6/1922 | Brandt | 52/93 |
| 1,998,448 | 4/1935 | Crowe | 52/220 |
| 2,129,441 | 9/1938 | Otto | 52/474 |
| 2,350,904 | 6/1944 | King | 52/93 |
| 3,236,020 | 2/1966 | Toffolon | 52/745 |
| 3,755,975 | 9/1973 | Herzer et al. | 52/90 |

FOREIGN PATENT DOCUMENTS

| | | | |
|---|---|---|---|
| 520703 | 1/1956 | Canada | 52/474 |
| 892577 | 10/1944 | France | 52/745 |
| 603574 | 6/1948 | United Kingdom | 52/90 |
| 1084978 | 9/1967 | United Kingdom | 52/580 |

*Primary Examiner*—James L. Ridgill

*Attorney, Agent, or Firm*—Jacobson and Johnson

[57] ABSTRACT

A structure made of subassemblies and a method of assembling a structure wherein the floor and an end wall are first erected followed by positioning a set of U-shaped members on the floor and adjacent each other with the U-shaped members secured to each other and the floor to provide a rigid self-supporting structure.

1 Claim, 5 Drawing Figures

METHOD OF CONSTRUCTING HOUSES

BACKGROUND OF THE INVENTION

1. Field of the Invention

This invention relates generally to building construction and, more specifically, to a method of constructing a modified A-frame building.

2. Description of the Prior Art

The concept of building structures is well known in the prior art. One of the more popular building processes is building structures with boards that are sawed to length and assembled at the building site. Other processes involve building a structure which is cast in one piece using such materials as plastic or concrete. In addition, other prior art methods involve making modular compartments and shipping the compartments to a site where they are assembled. The modular units usually require a crane or other heavy equipment to assemble the modular structure.

The present invention comprises a method for assembling a structure which does not require use of heavy equipment such as cranes or the like yet provides a method for quick erection of a structure in a minimum amount of time.

BRIEF SUMMARY OF THE INVENTION

Briefly, the present invention comprises a structure made of subassemblies and a method for constructing a building wherein sections are shipped to a building site for assembly at the building site. The process involves forming a floor and then erecting a preassembled end section on the floor. Next, flat subsections are formed into a U-shaped assembly that can conveniently and quickly be winched into position. When in position, the sections are securely fastened to each other to provide an integral assembly.

DESCRIPTION OF THE PREFERRED EMBODIMENT

Figure 1:
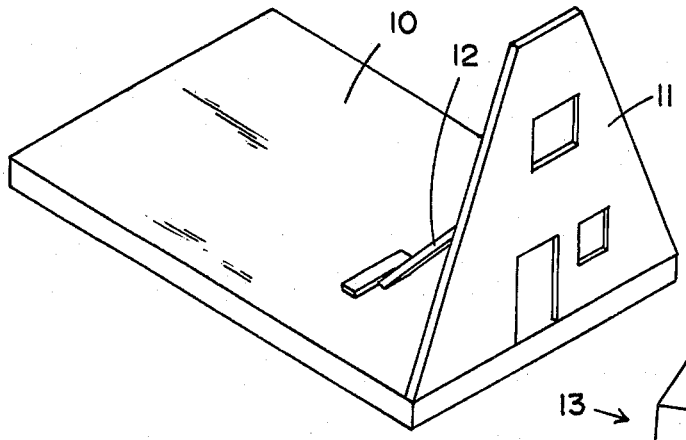
FIG. 1 shows a building partially assembled.

Referring to FIG. 1, reference numeral 10 generally designates a floor or foundation for my building. Floor or foundation 1 may be a wood or a concrete slab floor depending upon the preference or location. Supporting floor 10 are floor joists 50 (see detail in FIG. 5). Located on one end of floor 10 is a front section 11 having openings for doors and windows. Front section 10 is temporarily supported in a vertical position on floor 10 by brace 12. Front section 11 comprises a wood assembly of stud walls having plywood sheathing on the outside and paneling on the interior. Front section 11 has a general tradezoidal shape with openings for doors and windows therein. Located between the studs is a suitable insulation such as fiberglass or the like. While only front section 11 is shown it will be understood that there is a similar back section which fastens to the opposite end of floor 10. Back section may differ from front section 11 in placement of doors or windows.

In the process of erecting a structure with my process the first step is to position front section 11 on the end of floor 10 as shown in FIG. 1. Front section 11 is raised to the vertical position with brace 12. Once front section 11 is in the vertical position, temporary braces such as brace 12 are used to securely hold section 11 in an upright vertical position. In the next step a set of U-shaped sections 13 are winched into position against front section 11. Sections 13 are fastened to each other to provide an integral structure. The last step is to fasten a back section to the opposite end of floor and the U-shaped enclosure section 13. After assembly, the roofing material such as shingles can be applied to the exterior of the structure.

Figure 2:
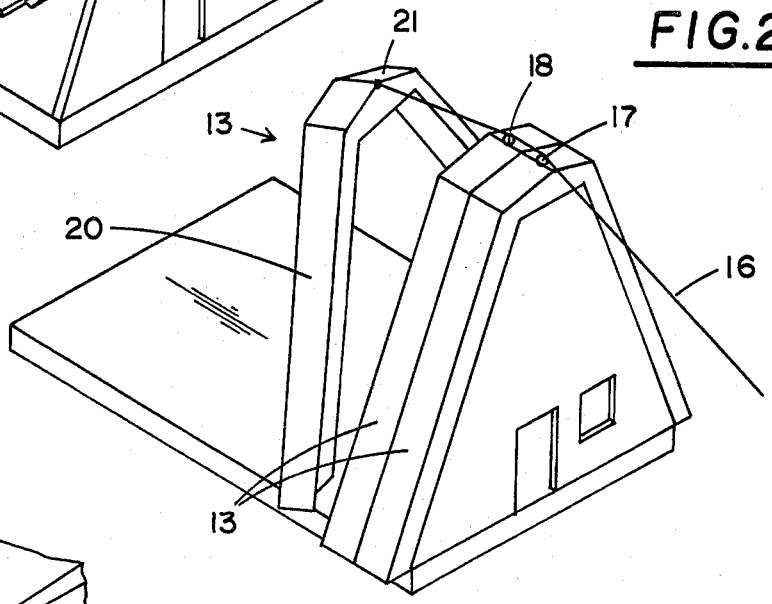
FIG. 2 shows a building being assembled.
Figure 3:
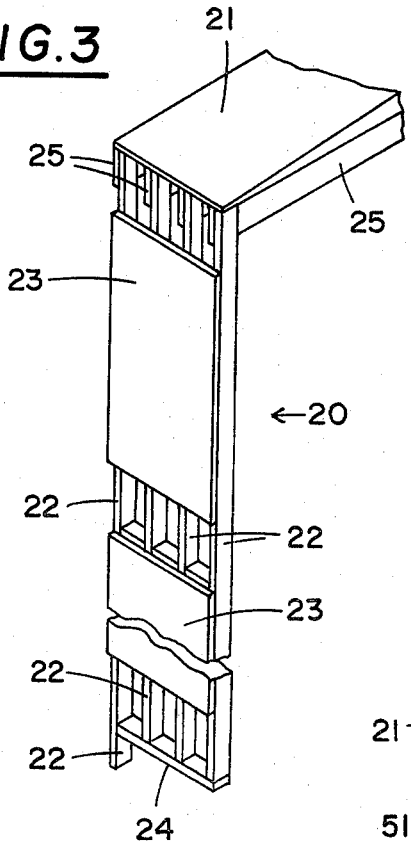
FIG. 3 shows a detail of an assembled section.
Figure 4:
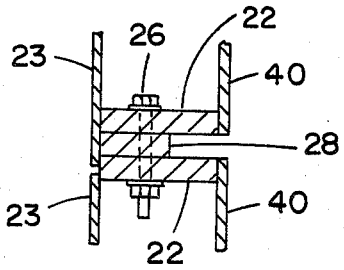
FIG. 4 shows a detail of sections fastened together.
Figure 5:
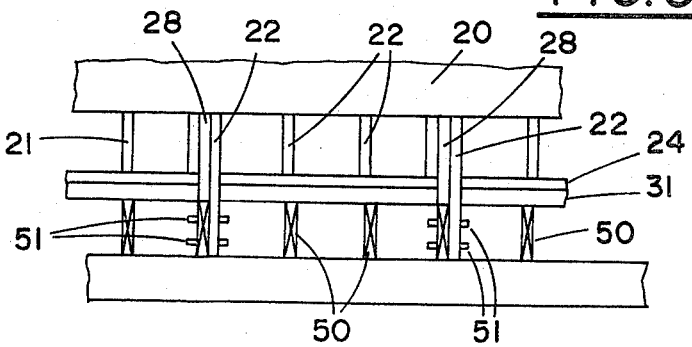
FIG. 5 shows a detail of the floor to wall assembly.

To understand the assembly of sections 13, reference should be made to FIGS. 3, 4, and 5. FIG. 3 shows in greater detail intermediate sections 13 which comprise a side section 20, a roof section 21, and a second side section (not shown) which is identical to side section 20. Typically, side section 20 comprises four 2×6 members that extend from a plate 24 to join top section 21. The sections are made in four foot widths to accommodate conventional four foot widths of plywood 23 and interior paneling (not shown). On one side of section 20 is a stud 22 that extends and protrudes beyond the bottom plate 24 while the other studs 21 abut against plate 24. Note, the tops of studs 22 extend or project outward without a plate thereon. The purpose of having free ends on studs 22 is to provide means for engagement of studs 21 and 22 with roof rafters 25 on section 21. FIG. 3 shows side section only partially covered with plywood. There are three uncovered areas of section 20; a top area, an intermediae area, and a lower area which are not covered. Each of these sections are covered with sheathing after sections 13 are assembled. The reason for having uncovered areas is to permit one to fasten sections together. For example, side section 20 fastens to roof section 21 through fasteners such as bolts or the like. Typically, three bolts fasten through each of roof rafters 25 and studs 22 from either the inside or outside of section 20. In the assembly of section 13, one fastens side sections 20 to opposite sides of roof section 21 when all the sections are on the ground. After the assembled sections are bolted together, the U-shaped structure 13 can be raised and bolted in place as shown in FIG. 2. Note, the upper and lower uncovered areas in section 20 permit easy fastening of sections 13 to one another. The intermediate uncovered area in section 20 provide an opening for assembling a second level in the structure, i.e. floor joists can be extended from side section to side section and fastened thereto to provide support for a second level.

To understand how roof section 21 and side sections 20 may be erected without a crane reference should be made to FIG. 2. To erect subassembly 13, one positions a cable 16 through pulleys 17 and 18 which are temporarily fastened to a portion of the U-shaped subassemblies 13. To position subassemblies 13 into proper position the aooperator pulls cable 16 thereby elevating subassembly 13 into a position abuting against the other subassemblies. Subassemblies 13 when in the abuting position against each other are bolted together to form the subassemblies and front sections into an integral structure. While the pulleys are shown attached to sections 13, it is apparent that the first section 13 is erected by fastening a pulley to end section 11.

Reference to FIG. 4 reveals the details of fastening subassemblies 13 to one another. Subassemblies 13 are joined by studs 22 of adjacent sections. Note, fastened to stud 21 is a filler member 28. When adjoining subassemblies are fastened together filler member 28 forms a recess or gap between the two sections. The gap provides a convenient raceway for plumbing or electrical conduits. When completed, a paneling strip covers the opening located between adjoining sections.

FIG. 4 shows that the exterior sheathing 23 extends about half the thickness onto stud 22. Note, the sheathing 23 on the adjoining section extends only half way onto stud 22. The overlapping sheathing on stud 22 insures that the two sections can be fastened together without cracks or spacing between the sections.

Referring to FIG. 5, the detail of fastening section 20 to the floor joists is shown in greater detail. Member 20 is shown with stud 22 fastened to floor joists 50 with bolts 51. Every fourth stud is fastened to the floor joists; however, further means of fastening can be provided through plate 31 and plate 24.

I claim:

1. An assembly for erecting a building structure on a floor comprising:

a floor for a building comprising a plurality of floor joists and a plurality of floor plates thereon;

a front section for fastening to one end of said floor;

a back section for fastening to the opposite end of said floor;

a plurality of intermediate sections for fastening to said floor each of said plurality of intermediate sections including a pair of wall sections and a roof section, said roof section joined to each of said pair of wall sections to form an A-shaped rigid intermediate section for assembling into a building structure, each of said intermediate sections having a side for joining with another intermediate section, said side of said intermediate section having a filler member thereon to provide spacing between adjacent intermediate sections so that when said intermediate sections are joined together they coact to provide a raceway for conduits, said intermediate sections having a bottom plate and a side member, said side member extending past said bottom plate to engage one of said floor joists when said intermediate section is in an erected position on said floor;

means for holding said floor joists and said side member which are in engagement with one another in an integral relationship to thereby form a rigid connection between said floor joists and said intermediate section side member so that said floor and said intermediate section form an integral structure;

said intermediate sections, said front section and said back section coacting to provide an enclosure over said floor, each of said intermediate sections having a stud framework with a sheet of material extending partially along said framework so that said stud framework intermediate section is exposed for access, said sheet of material extending sideways past said stud framework so that when said intermediate sections are assembled to each other said sheet of material overlaps an adjacent intermediate section to prevent gaps between adjacent intermediate sections.

* * * * *